US009557699B2

(12) United States Patent
Hosoda

(10) Patent No.: US 9,557,699 B2
(45) Date of Patent: Jan. 31, 2017

(54) IMAGE FORMING APPARATUS, CONTROL METHOD, AND PROGRAM FOR DETERMINING A REMAINING AMOUNT OF RECORDING MATERIAL

(71) Applicant: CANON KABUSHIKI KAISHA, Tokyo (JP)

(72) Inventor: Yuichi Hosoda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/323,909

(22) Filed: Jul. 3, 2014

(65) Prior Publication Data

US 2015/0010314 A1 Jan. 8, 2015

(30) Foreign Application Priority Data

Jul. 8, 2013 (JP) ..... 2013-142794

(51) Int. Cl.
*G03G 15/08* (2006.01)
*G03G 15/00* (2006.01)

(52) U.S. Cl.
CPC ..... *G03G 15/556* (2013.01); *G03G 15/0856* (2013.01); *G03G 15/502* (2013.01)

(58) Field of Classification Search
CPC G03G 15/0856; G03G 15/502; G03G 15/556; G03G 15/5016
USPC ..... 399/27, 81
See application file for complete search history.

(56) References Cited

U.S. PATENT DOCUMENTS

| | | | | |
|---|---|---|---|---|
| 5,797,061 | A * | 8/1998 | Overall et al. | 399/27 |
| 5,802,420 | A * | 9/1998 | Garr et al. | 399/27 |
| 6,408,143 | B2 * | 6/2002 | Sakurai et al. | 399/27 |
| 6,594,451 | B2 * | 7/2003 | Kakeshita et al. | 399/24 |
| 7,061,391 | B2 * | 6/2006 | Hopper et al. | 340/691.1 |
| 8,238,767 | B2 * | 8/2012 | Kawarazuka et al. | 399/27 |
| 2003/0012576 | A1 * | 1/2003 | Owen et al. | 399/27 |
| 2003/0035656 | A1 * | 2/2003 | Yamamoto et al. | 399/27 |
| 2005/0226642 | A1 * | 10/2005 | Rodriguez | G03G 15/5079 399/27 |
| 2005/0265738 | A1 * | 12/2005 | Ogata | 399/27 |
| 2006/0127108 | A1 * | 6/2006 | Okuyama et al. | 399/27 |
| 2006/0245770 | A1 * | 11/2006 | Choi | 399/27 |
| 2006/0280513 | A1 * | 12/2006 | Hatakeyama | 399/27 |
| 2007/0201886 | A1 * | 8/2007 | Watanabe | G03G 15/0862 399/27 |
| 2007/0206966 | A1 * | 9/2007 | Komiya et al. | 399/27 |
| 2008/0131146 | A1 | 6/2008 | Kendall | |
| 2008/0232828 | A1 * | 9/2008 | Golding et al. | 399/27 |
| 2008/0232829 | A1 * | 9/2008 | Golding et al. | 399/27 |

(Continued)

FOREIGN PATENT DOCUMENTS

| | | | |
|---|---|---|---|
| CN | 1790182 | A | 6/2006 |
| JP | P2006-343621 | A | 12/2006 |

*Primary Examiner* — David Bolduc
(74) *Attorney, Agent, or Firm* — Canon U.S.A., Inc., IP Division

(57) ABSTRACT

An image forming apparatus determines a remaining recording material amount based on a sensor value and a predicted value. When a sensor falsely detects the remaining recording material amount, the image forming apparatus appropriately determines the remaining recording material amount. Upon acquisition of a new sensor value, the image forming apparatus does not update a current value with the new sensor value if a difference between the new sensor value and the current value is a predetermined value or greater.

8 Claims, 9 Drawing Sheets

(56) References Cited

U.S. PATENT DOCUMENTS

| | | | | |
|---|---|---|---|---|
| 2008/0273047 | A1* | 11/2008 | Kawarazuka | B41J 2/17509 347/6 |
| 2009/0010659 | A1* | 1/2009 | Watanabe | G03G 15/553 399/27 |
| 2011/0076036 | A1 | 3/2011 | Hiraike | |
| 2012/0195611 | A1* | 8/2012 | Adachi | G03G 15/0831 399/53 |
| 2013/0028616 | A1* | 1/2013 | Kunihiro et al. | 399/27 |

* cited by examiner

IMAGE FORMING APPARATUS, CONTROL METHOD, AND PROGRAM FOR DETERMINING A REMAINING AMOUNT OF RECORDING MATERIAL

BACKGROUND

Field

The present invention relates to an image forming apparatus, a control method, and a program.

Description of Related Art

Image forming apparatuses form images on sheets with recording materials such as toner. Generally, the recording material is stored in a storage unit such as a cartridge. In some instances, the image forming apparatuses may detect a remaining amount of the recording material in the storage unit to display the detected amount on a display unit such as a user interface (UI).

Conventionally, the image forming apparatuses include sensors. Such a conventional image forming apparatus displays an amount of a recording material detected by the sensor as a remaining recording material amount. However, in consideration of the cost, there are many cases where the image forming apparatus employs a sensor that cannot achieve favorable detection accuracy until the remaining amount becomes relatively small. In such a case, the sensor discretely detects the remaining recording material amounts of 100%, 20%, and 0%, for example. As a result, the remaining amount of the recording material is discretely displayed at, for example, 100%, 20%, and 0% on a display unit.

On the other hand, Japanese Patent Application Laid-Open No. 2006-343621 discusses an image forming apparatus using a technique for seamlessly displaying a remaining toner amount on a display unit in spite of the use of a sensor which discretely detects a remaining amount. For example, when the image forming apparatus forms an image, a predicted value of a remaining toner amount is calculated based on a dot count value of raster data, and the resultant value is displayed as a current value of the remaining toner. When the image forming apparatus acquires a value of the remaining toner amount from the sensor, the current value is updated with the sensor value.

However, the sensor may falsely detect the remaining toner amount due to a limited capability of the sensor or affected by a level of the remaining toner amount. Consequently, the false remaining toner amount may be notified by the sensor which is significantly different from the actual remaining toner amount, as a sensor value. In this case, when the current value is updated with the sensor value, the current value does not come close to the actual remaining toner amount, and significantly deviates from the actual remaining toner amount. As a result, the value significantly deviating from the actual remaining toner amount is displayed on a display unit, and thus such a display confuses a user.

SUMMARY

The present application is directed to an image forming apparatus determining a remaining recording material amount based on a sensor value and a predicted value. Even when a sensor falsely detects the remaining recording material amount, the image forming apparatus can appropriately determine the remaining recording material amount.

According to a first aspect of the present application, an image forming apparatus with an attachable storage unit storing a recording material and an image forming unit performing image forming using the recording material includes an acquisition unit configured to acquire a remaining recording material amount in the storage unit, a prediction unit configured to predict a remaining recording material amount in the storage unit based on data used in the image forming, a setting unit configured to set the remaining recording material amount predicted by the prediction unit as a remaining recording material amount to be displayed, and a control unit configured to, when a remaining recording material amount acquired by the acquisition has changed, update the remaining recording material amount set by the setting unit with the remaining recording material amount acquired by the acquisition unit. The control unit updates the remaining recording material amount set by the setting unit with the remaining recording material amount acquired by the acquisition unit when a difference between the remaining recording material amount acquired by the acquisition unit and the remaining recording material amount set by the setting unit is less than a predetermined amount, and the control unit does not update the remaining recording material amount set by the setting unit with the remaining recording material amount acquired by the acquisition unit when the difference between the remaining recording material amount acquired by the acquisition unit and the remaining recording material amount set by the setting unit is greater than the predetermined amount.

Further features will become apparent from the following description of exemplary embodiments with reference to the attached drawings.

DETAILED DESCRIPTION

Various exemplary embodiments, features, and aspects of the instant application and subject matter will be described in detail below with reference to the drawings.

Figure 1:
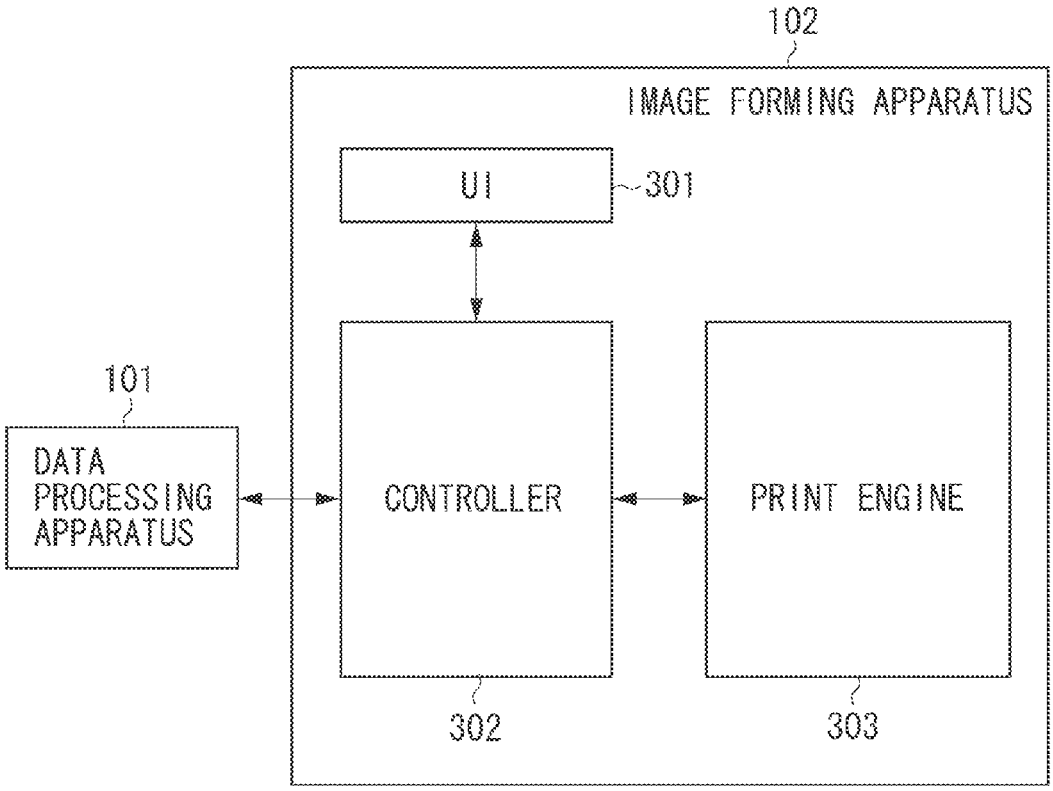
FIG. 1 is a block diagram illustrating a configuration of an image forming apparatus.

FIG. 1 is a block diagram illustrating a configuration of an image forming apparatus 102 according to a first exemplary embodiment.

A data processing apparatus 101 (e.g., a personal computer (PC)) generates image data, and transmits the generated image data to the image forming apparatus 102.

The image forming apparatus 102 (e.g., a laser printer) receives the image data from the data processing apparatus 101, and then, forms an image on a sheet based on the received image data. The image forming apparatus 102 may be a multifunctional peripheral including a scanner function and a facsimile function.

A user interface (UI) 301 includes a display unit for notifying a user of various information, and an operation unit for receiving various operations from the user. On the display unit, a current value of a remaining toner amount is displayed. Alternatively, the current value of the remaining toner amount may be transmitted to an external device such as the data processing apparatus 101 via a host interface (I/F) and displayed on a display unit of the external device.

A controller 302 generates bitmap data based on page description language (PDL) data, and transmits the generated bitmap data to a print engine 303. The controller 302 will be described in detail with reference to FIG. 2.

The print engine 303 uses an electrophotographic method to form an image on a sheet with toner, the image being formed based on the bitmap data received from the controller 302. The print engine 303 may use, for example, an inkjet method other than the electrophotographic method. A recording material used in the electrophotographic method is toner, whereas a recording material used in the inkjet method is ink.

The controller 302 and the print engine 303 are separate members. However, the controller 302 and the print engine 303 may be integrated.

Figure 2:
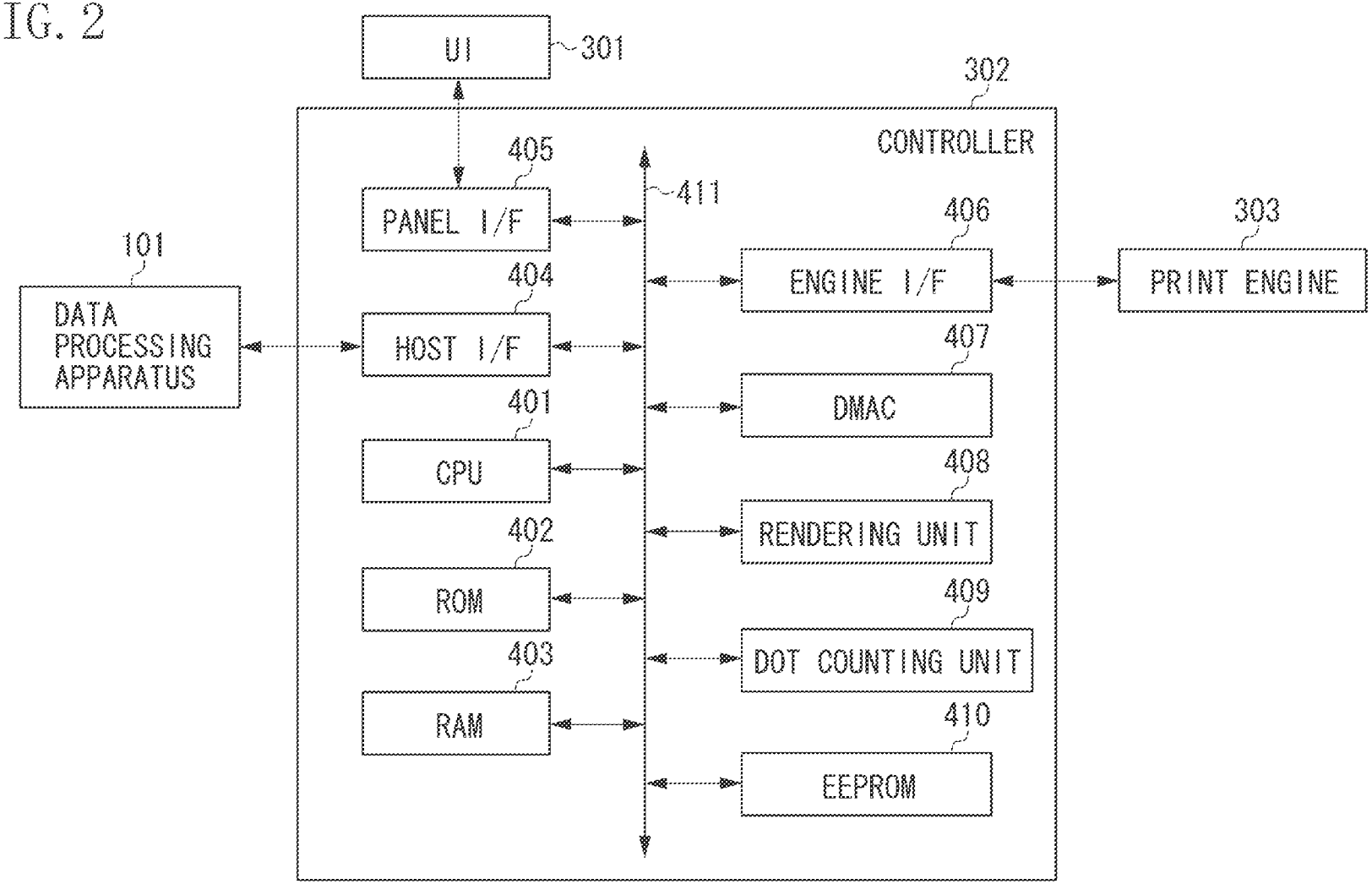
FIG. 2 is a block diagram illustrating a configuration of a controller.

FIG. 2 is a block diagram illustrating a configuration of the controller 302.

A central processing unit (CPU) 401 controls the image forming apparatus 102 by loading a program stored in a read only memory (ROM) 402 into a random access memory (RAM) 403 and executing the loaded program. Moreover, the CPU 401 calculates a remaining toner amount based on a predicted value of a toner consumption amount into which a dot count value counted by a dot counting unit 409 is converted, and a sensor value of a remaining toner amount notified from the print engine 303. The CPU 401 can display the calculated remaining toner amount on the UI 301 via a panel I/F 405, or can also notify the data processing apparatus 101 of the calculated remaining toner amount via a host I/F 404.

The ROM 402 stores programs to be executed by the CPU 401.

The RAM 403 stores programs loaded from the ROM 402. Moreover, the RAM 403 stores PDL data, intermediate data generated by interpreting the PDL data, bitmap data generated by rendering the intermediate data, a temporary status of each of various processing needed for the other processing, and log information.

The host I/F 404 mutually connects the data processing apparatus 101 and the controller 302 to relay bidirectional data communication, that is, transmission and reception of data.

The panel I/F 405 mutually connects the UI 301 and the controller 302 to relay bidirectional data communication, that is, transmission and reception of data.

An engine I/F 406 mutually connects the print engine 303 and the controller 302 to relay bidirectional data communication, that is, transmission and reception of data.

A direct memory access controller (DMAC) 407 receives a command from the CPU 401 to access data in the RAM 403, that is, reads and writes data with respect to the RAM 403.

A rendering unit 408 rasterizes intermediate data into bitmap data.

The dot counting unit 409 counts the number of dots in the rasterized bitmap data.

An electrically erasable programmable read only memory (EEPROM) 410 stores information such as setting information of the image forming apparatus 102.

A bus 411 mutually connects each of the components inside the controller 302.

Figure 3:
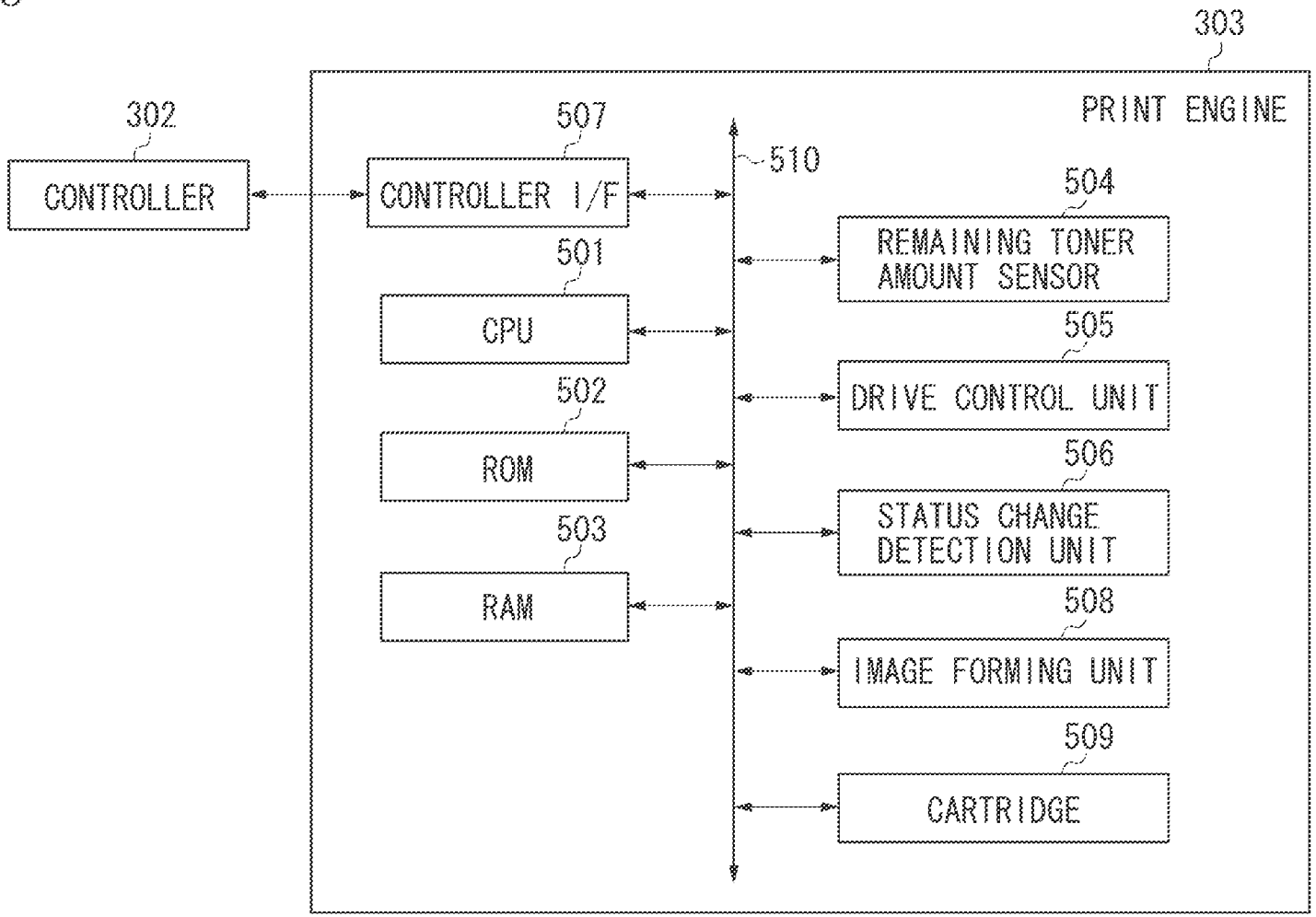
FIG. 3 is a block diagram illustrating a configuration of a print engine.

FIG. 3 is a block diagram illustrating a configuration of the print engine 303.

A CPU 501 controls the print engine 303 by loading a program stored in a ROM 502 into a RAM 503 and executing the loaded program.

The ROM 502 stores programs to be executed by the CPU 501.

The RAM 503 stores programs loaded from the ROM 502.

A remaining toner amount sensor 504 measures an amount of remaining toner in a cartridge 509.

A drive control unit 505 drives various motors that are needed when an image forming unit 508 forms an image.

A status change detection unit 506 detects changes in status of the image forming apparatus 102. The status includes a sheet jam and cover opening. Moreover, the status change detection unit 506 detects replacement of the cartridge 509.

A controller I/F 507 mutually connects the controller 302 and the print engine 303 to relay bidirectional data communication, that is, transmission and reception of data.

The image forming unit 508 forms an image on a sheet with toner according to an electrophotographic method, the image being formed based on bitmap data received from the controller 302.

The cartridge 509, serving as a storage unit for storing toner, is a process cartridge attachable to the image forming apparatus 102. The cartridge 509 stores toner to be used when an image is formed by the image forming unit 508. Moreover, the cartridge 509 includes a sensor for detecting a remaining toner amount. The remaining toner amount detected by the sensor is notified as a sensor value by the cartridge 509. The sensor detects a remaining toner amount using a method such as a magnetic permeability detection method, a magnet method, a piezoelectric vibration method, and a transmitted light method. The sensor may use any of these methods. When a remaining toner amount reaches a predetermined value such as 20% and 0%, such a value is notified as a sensor value by the sensor. The sensor may temporarily detect a false value (a value significantly deviating from an actual remaining toner amount) due to extreme changes in surrounding environment such as temperature and humidity. The cartridge 509 includes a non-volatile storage medium to store cartridge information. The cartridge information includes, for example, information indicating whether the cartridge 509 is new, color information indicating the color of toner in the cartridge 509, and remaining toner amount information indicating a current remaining toner amount in the cartridge 509. Although the cartridge 509 is connected to a bus 510, the cartridge 509 may be connected to the CPU 501 via a dedicated line.

The bus 510 mutually connects each of the components inside the print engine 303.

Figure 4:
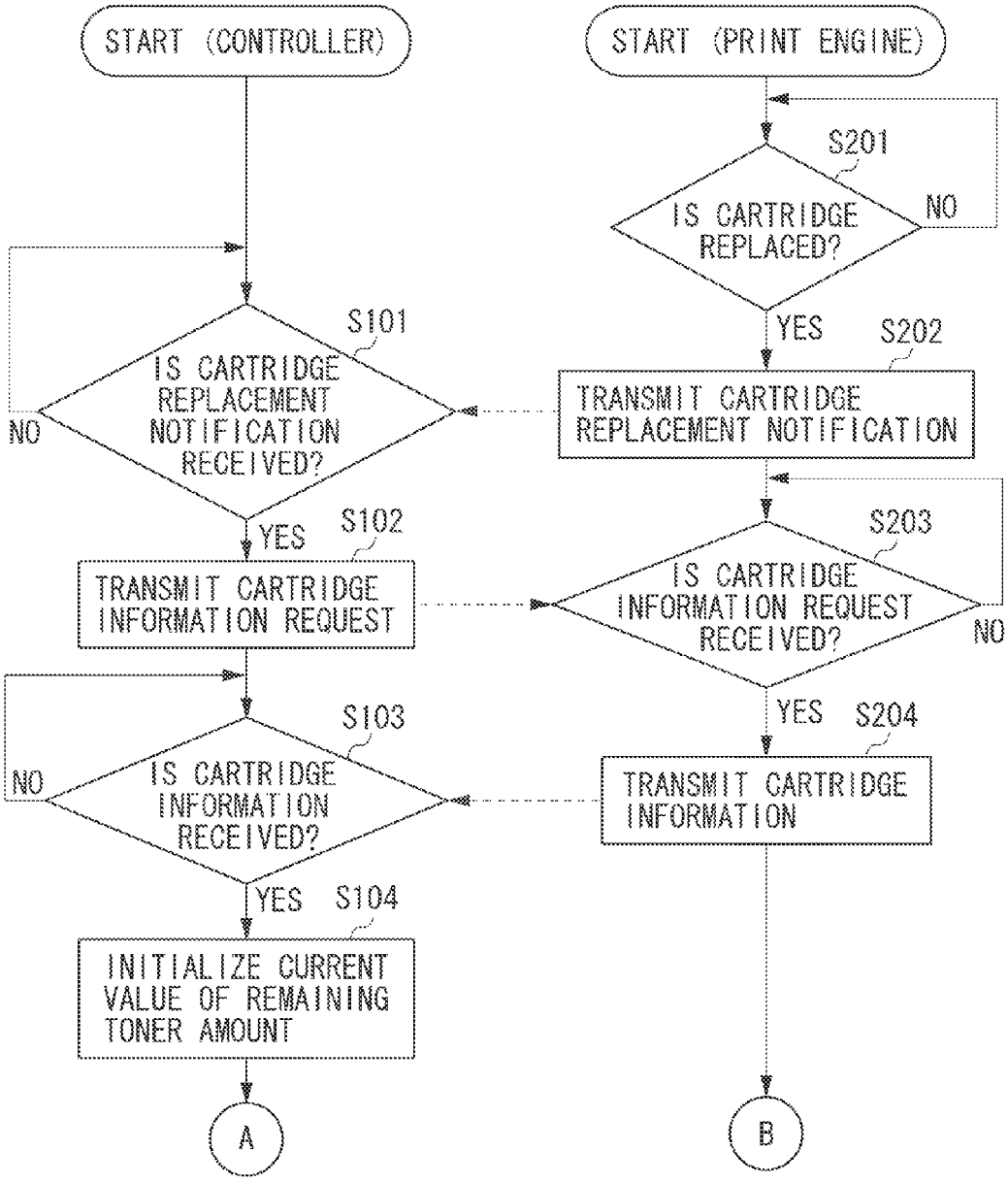
FIG. 4 is a flowchart illustrating the first half of processing performed when detection of a remaining toner amount is controlled.
Figure 5:
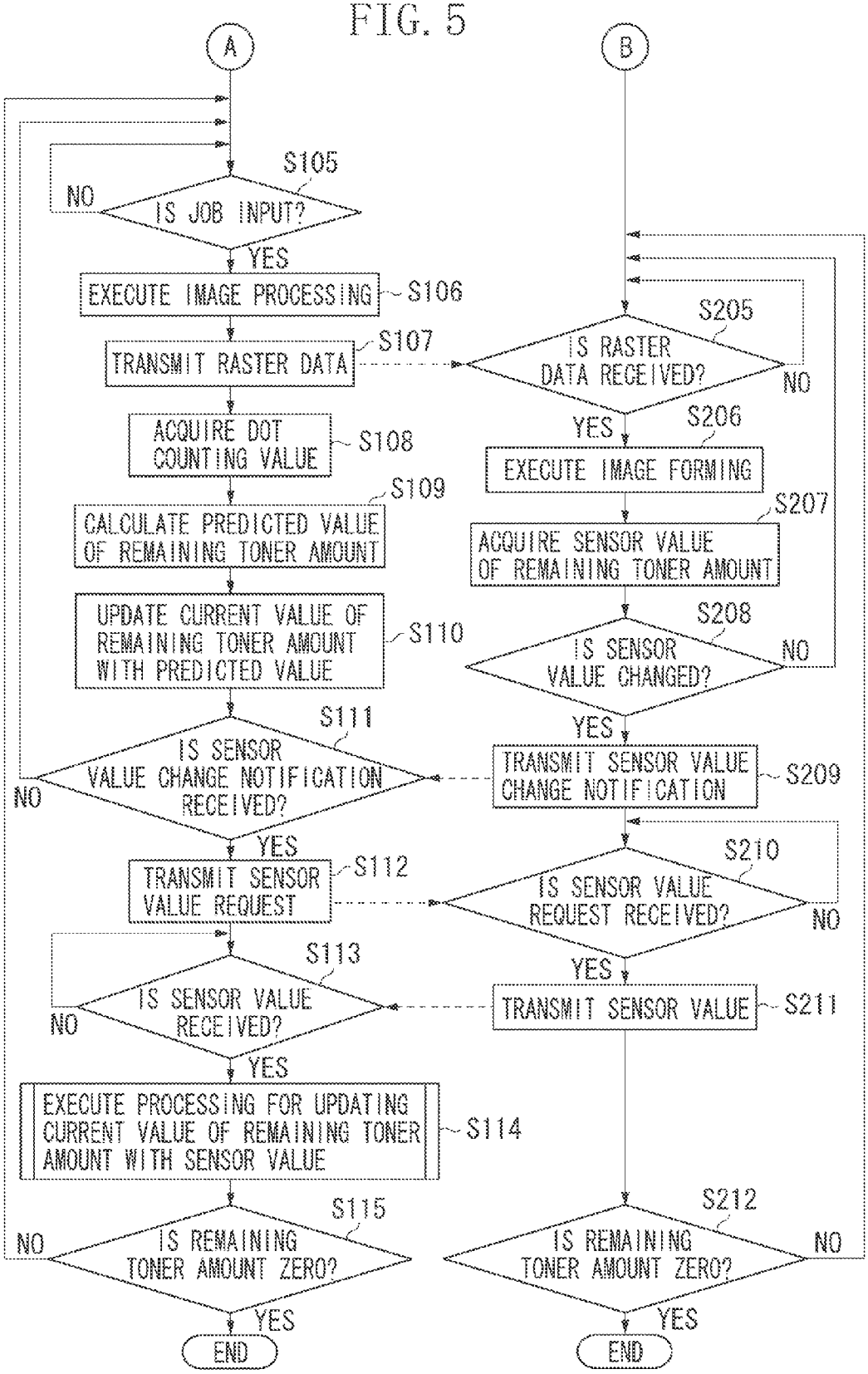
FIG. 5 is a flowchart illustrating the second half of processing performed when the detection of the remaining toner amount is controlled.

FIGS. 4 and 5 are flowcharts illustrating processing performed when detection of a remaining toner amount is controlled.

The left side of the flowcharts illustrated in FIGS. 4 and 5 indicates control performed by the CPU 401 in the controller 302. The CPU 401 loads a control program stored in the ROM 402 into the RAM 403, and executes the loaded program to perform the control. The right side of the flowcharts illustrated in FIGS. 4 and 5 indicates control performed by the CPU 501 in the print engine 303. The CPU 501 loads a control program stored in the ROM 502 into the RAM 503, and executes the loaded program to perform the control.

In step S201, the CPU 501 determines whether the cartridge 509 is replaced. The replacement of the cartridge 509 is detected by the status change detection unit 506. Upon detection of the replacement, the status change detection unit 506 notifies the CPU 501 accordingly. The status change detection unit 506 detects the replacement of the cartridge 509 based on a button or a switch the state of which physically changes between ON and OFF in response to attachment and detachment of a component. Alternatively, the replacement of the cartridge 509 may be detected by another method. If the CPU 501 determines that the cartridge 509 is replaced (YES in step S201), the operation proceeds to step S202. If the cartridge 509 is not replaced (NO in step S201), the operation is on standby.

In step S202, the CPU 501 transmits a cartridge replacement notification to the controller 302 via the controller I/F 507, the cartridge replacement notification indicating that the cartridge 509 has been replaced.

Next, in step S101, the CPU 401 determines whether the cartridge replacement notification is received from the print engine 303 via the engine I/F 406. If the CPU 401 determines that the cartridge replacement notification is received (YES in step S101), the operation proceeds to step S102. If the cartridge replacement notification is not received (NO in step S101), the operation is on standby.

In step S102, the CPU 401 transmits a request for cartridge information of the cartridge 509 to the print engine 303 via the engine I/F 406.

Subsequently, in step S203, the CPU 501 determines whether the cartridge information request is received from the controller 302 via the controller I/F 507. If the CPU 501 determines that the cartridge information request is received (YES in step S203), the operation proceeds to step S204. If the cartridge information request is not received (NO in step S203), the operation is on standby.

In step S204, the CPU 501 transmits the cartridge information of the cartridge 509 to the controller 302 via the controller I/F 507.

Subsequently, in step S103, the CPU 401 determines whether the cartridge information is received from the print engine 303 via the engine I/F 406. If the CPU 401 determines that the cartridge information is received (YES in step S103), the operation proceeds to step S104. If the cartridge information is not received (NO in step S103), the operation is on standby.

In step S104, the CPU 401 initializes a current value of a remaining toner amount based on the cartridge information. Here, the current value of the remaining toner amount is a value recognized by the controller 302 as a remaining toner amount of the cartridge 509. The current value of the remaining toner amount is displayed to a user via the UI 301. When initializing the current value of the remaining toner amount, specifically, the CPU 401 refers to the cartridge information. If the cartridge 509 is new, the CPU 401 sets the current value of the remaining toner amount to 100%. If the CPU 401 cannot determine whether the cartridge is new, the CPU 401 sets the current value of the remaining toner amount to a value corresponding to remaining toner information in the above cartridge information.

Subsequently, in step S105, the CPU 401 determines whether a job to execute image forming is input from the data processing apparatus 101 via the host I/F 404. Here, the job includes PDL data. If the CPU 401 determines that the job is received (YES in step S105), the operation proceeds to step S106. If the job is not received (NO in step S105), the operation is on standby.

In step S106, the CPU 401 executes image processing that is necessary to form an image based on the print job. Here, the image processing includes control of the rendering unit 408 to generate raster data by rasterizing PDL data.

In step S107, the CPU 401 transmits the raster data generated by the image processing to the print engine 303 via the engine I/F 406.

In step S108, the CPU 401 acquires a dot count value measured when the raster data is generated, the dot count value being acquired from the dot counting unit 409. The dot count value may be acquired on a page-by-page basis or a job-by-job basis.

In step S109, the CPU 401 calculates, based on the dot count value, a predicted value of the remaining toner amount subsequent to execution of the image forming. Specifically, first, the CPU 401 makes a calculation: (a dot count value [dot] in execution of printing of a job or a page this time)*(a toner consumption amount per dot [g/dot])=(a toner consumption amount [g] by the execution of printing of the job or the page this time). Secondly, the CPU 401 makes a calculation: (a current remaining toner amount [g])−(the toner consumption amount [g] by the execution of printing of the job or the page this time)=(a new remaining toner amount [g]). Lastly, the CPU 401 makes a calculation: (the new remaining toner amount [g])/(a remaining toner amount [g] when a cartridge is in an unused state)=(a predicted value [%] of the new remaining toner amount).

Subsequently, in step S110, the CPU 401 updates the current value of the remaining toner amount with the predicted value calculated in step S109.

In step S205, the CPU 501 determines whether the raster data is received from the controller 302 via the controller I/F 507. If the CPU 501 determines that the raster data is received (YES in step S205), the operation proceeds to step S206. If the raster data is not received, (NO in step S205), the operation is on standby.

In step S206, the CPU 501 controls the image forming unit 508 to execute image forming based on the raster data.

In step S207, the CPU 501 acquires a sensor value of the remaining toner amount from the remaining toner amount sensor 504. The sensor value may be acquired at the time when image forming is completed on a page-by-page basis or a job-by-job basis. Moreover, the sensor value may be acquired whenever a predetermined time period has elapsed.

Subsequently, in step S208, the CPU 501 determines whether the sensor value acquired this time is changed from the sensor value acquired last time. If the CPU 501 determines that the sensor value is changed (YES in step S208), the operation proceeds to step S209. If the sensor value is not changed (NO in step S208), the operation returns to step S205.

In step S209, the CPU 501 transmits a sensor value change notification to the controller 302 via the controller I/F 507. The sensor value change notification indicates that the sensor value has been changed.

In step S111, the CPU 401 determines whether the sensor value change notification is received from the print engine 303 via the engine I/F 406. If the CPU 401 determines that the sensor value change notification is received (YES in step S111), the operation proceeds to step S112. If the sensor value change notification is not received (NO in step S111), the operation returns to step S105.

In step S112, the CPU 401 transmits a request for the sensor value to the print engine 303 via the engine I/F 406.

In step S210, the CPU 501 determines whether the sensor value request is received from the controller 302 via the controller I/F 507. If the CPU 501 determines that the sensor value request is received (YES in step S210), the operation proceeds to step S211. If the sensor value request is not received (NO in step S210), the operation is on standby.

In step S211, the CPU 501 transmits the sensor value to the controller 302 via the controller I/F 507.

In step S113, the CPU 401 determines whether the sensor value is received from the print engine 303 via the engine I/F 406. If the CPU 401 determines that the sensor value is received (YES in step S113), the operation proceeds to step S114. If the sensor value is not received (NO in step S113), the operation is on standby.

In step S114, the CPU 401 executes processing for updating the current value of the remaining toner amount with the sensor value. The processing in step S114 will be described in detail below with reference to FIG. 6.

In step S115, the CPU 401 refers to the current value of the remaining toner amount, and determines whether the remaining toner amount is zero. If the CPU 401 determines that the remaining toner amount is zero (YES in step S115), the operation of the flowchart ends. If the remaining toner amount is not zero (NO in step S115), the operation returns to step S105.

Meanwhile, in step S212, the CPU 501 refers to the sensor value of the remaining toner amount, and determines whether the remaining toner amount is zero. If the CPU 501 determines that the remaining toner amount is zero (YES in step S212), the operation of the flowchart ends. If the remaining toner amount is not zero (NO in step S212), the operation returns to step S205.

Figure 6:
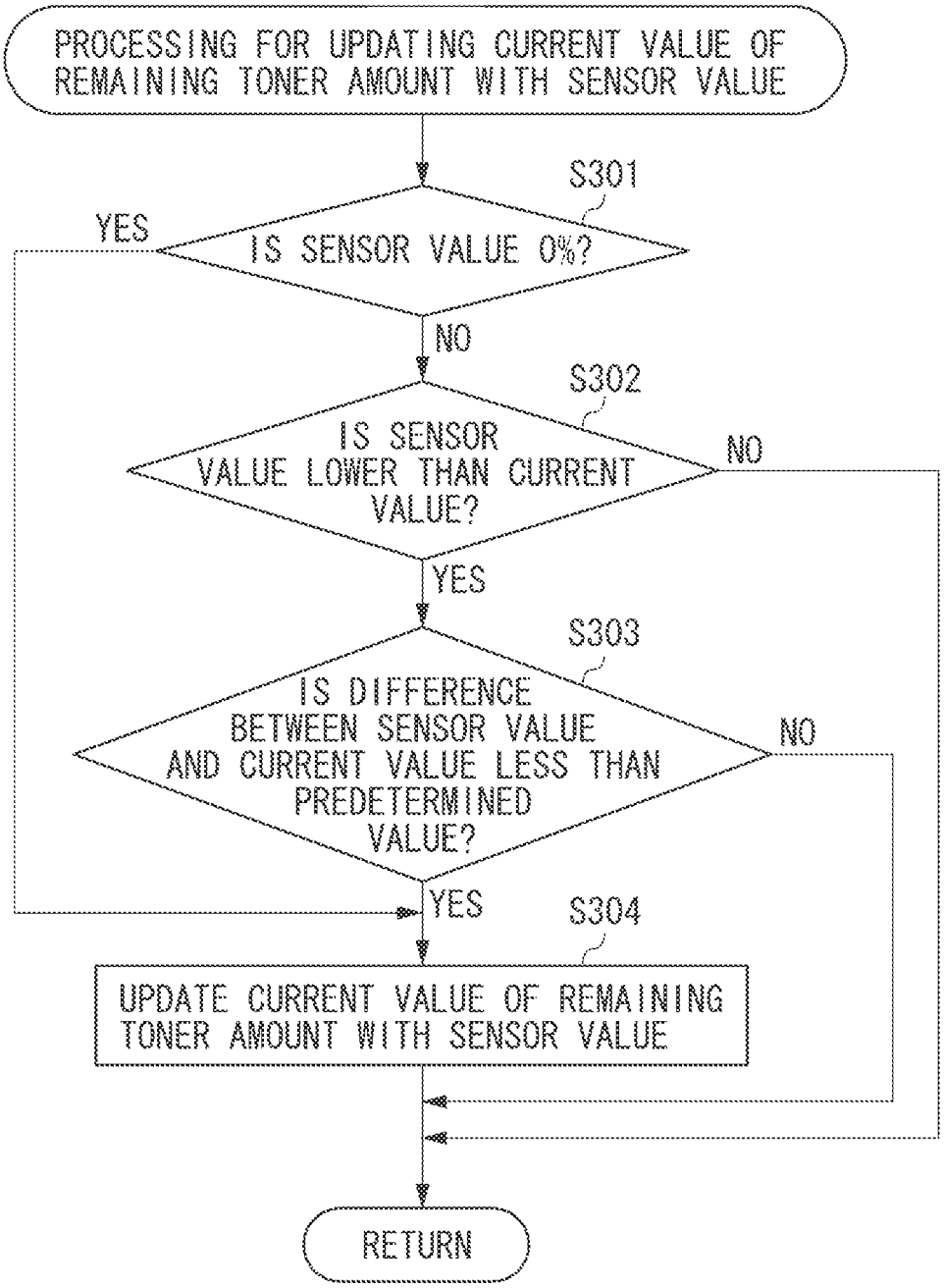
FIG. 6 is a detailed flowchart illustrating processing for updating a current value of a remaining toner amount with a sensor value.

FIG. 6 is a flowchart illustrating the processing for updating the current value of the remaining toner amount with the sensor value.

In step S301, the CPU 401 determines whether the sensor value is 0%. If the CPU 401 determines that the sensor value is 0% (YES in step S301), the operation proceeds to step S304. If the sensor value is not 0% (NO in step S301), the operation proceeds to step S302.

In step S302, the CPU 401 determines whether the sensor value is lower than the current value. If the sensor value is lower than the current value (YES in step S302), the operation proceeds to step S303. If the sensor value is not lower than the current value (NO in step S302), the operation returns to the flowchart illustrated in FIG. 5 without updating the current value with the sensor value. This can prevent the current value from returning to a higher value than now.

In step S303, the CPU 401 determines whether a difference between the sensor value and the current value is less than a predetermined value. Here, for example, the predetermined value is 5%. Alternatively, the predetermined value can be another value as long as the value is relatively small. If the difference between the sensor value and the current value is less than the predetermined value (YES in step S303), the operation proceeds to step S304. If the difference is not less than the predetermined value (NO in step S303), the operation returns to the flowchart illustrated in FIG. 5 without updating the current value with the sensor value. This prevents the current value from being updated to a false value in a case where the remaining toner is falsely detected by the sensor.

In step S304, the CPU 401 updates the current value with the sensor value. Thus, when the remaining toner is correctly detected by the sensor, the current value is updated to the correct value. Upon completion of the processing in step S304, the operation returns to the flowchart illustrated in FIG. 5.

Figure 7:
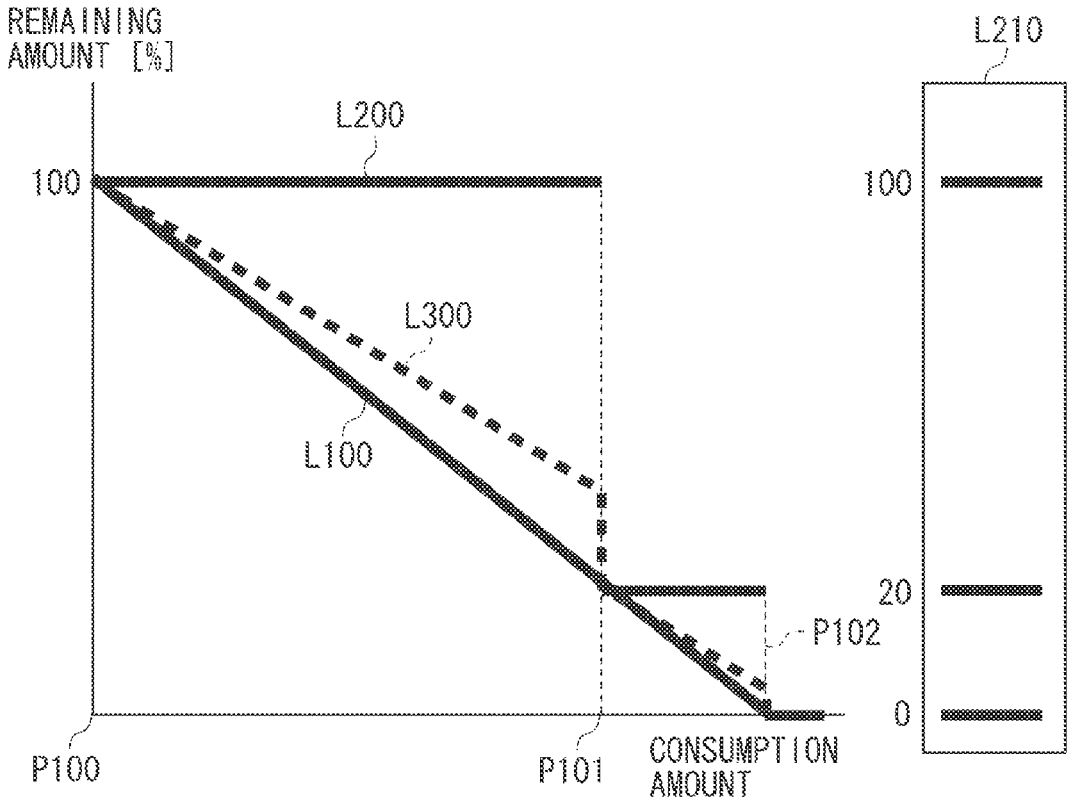
FIG. 7 is a diagram illustrating changes in a remaining toner amount (in a case where a remaining toner amount is not falsely detected by a sensor in the middle of sensor value detection).

FIG. 7 is a diagram illustrating changes in a remaining toner amount in a case where the remaining toner is not falsely detected by the sensor in the middle of sensor value detection.

In FIG. 7, a line L100 represents changes in an actual remaining toner amount. Here, the actual remaining toner amount is an accurate amount of a remaining toner that is actually present. Direct acquisition of the actual remaining toner amount is very difficult unless high accuracy sensors are arranged across the entire area, for example.

In FIG. 7, a line L200 represents changes in a sensor value of a remaining toner amount.

A line L210 indicates allowable values of the sensor value of the remaining toner amount. In the exemplary embodiment, the allowable values are 100%, 20%, and 0%. The allowable value of 20% is a threshold value of a low level (indicating that the toner is almost none and replacement of the cartridge is needed).

A line 300 illustrated in FIG. 7 represents changes in the current value of the remaining toner amount.

Each of points P100 through P102 illustrated in FIG. 7 represents a point of a physical quantity. A relationship between each of these points P100 through P102 and the current value is described below.

The point P100 corresponds to the time when the current value of the remaining toner amount is initialized to 100% in step S104 of the flowchart illustrated in FIG. 4. The current value is initialized when the cartridge 509 is replaced.

A section from the point P100 to the point P101 corresponds to a period in which the operation loop from step S105 to step S111 of the flowchart illustrated in FIG. 5 is repeated while the sensor value of the remaining toner amount changes from 100% to 20%. When the operation loop of step S105 to step S111 is repeated, the predicted value of the remaining toner amount is repeatedly calculated to continue to update the current value of the remaining toner amount.

In the point P101, the current value of the remaining toner amount changes quickly. The point P101 corresponds to the time when the current value of the remaining toner amount is updated to 20% in step S114 illustrated in FIG. 5 by using the sensor value of the remaining toner amount. The current value of the remaining toner amount is updated to 20% when the sensor value of the remaining toner amount changes from 100% to 20%.

A section from the point P101 to the point P102 corresponds to a period in which the operation loop from step S105 to step S111 of the flowchart illustrated in FIG. 5 is repeated while the sensor value of the remaining toner amount changes from 20% to 0%. When the operation loop of step S105 to step S111 is repeated, the predicted value of the remaining toner amount is repeatedly calculated to continue to update the current value of the remaining toner amount.

In the point P102, the current value of the remaining toner amount changes quickly. The point P102 corresponds to the time when the current value of the remaining toner amount is updated to 0% in step S114 illustrated in FIG. 5 by using the sensor value of the remaining toner amount. The current value of the remaining toner amount is updated to 0% when the sensor value of the remaining toner amount changes from 20% to 0%.

Figure 8A:
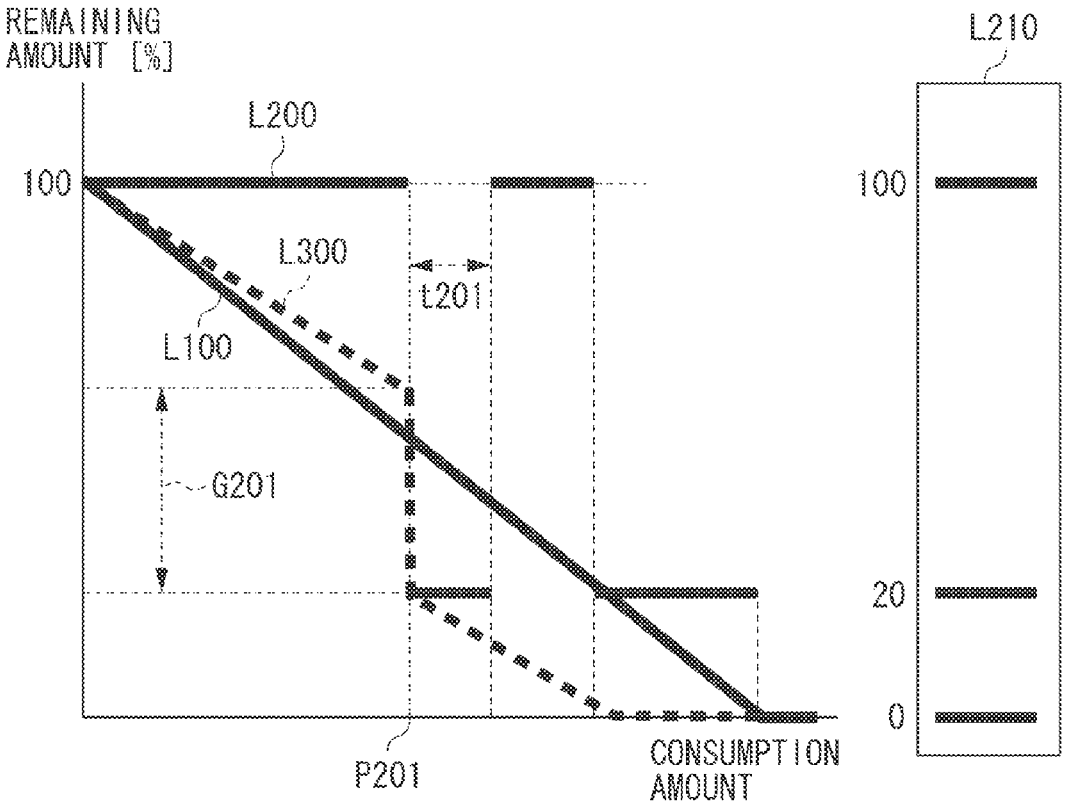
FIG. 8A and FIG. 8B are diagrams each illustrating changes in a remaining toner amount (in a case where a remaining toner amount is falsely detected by a sensor in the middle of sensor value detection).
Figure 8B:
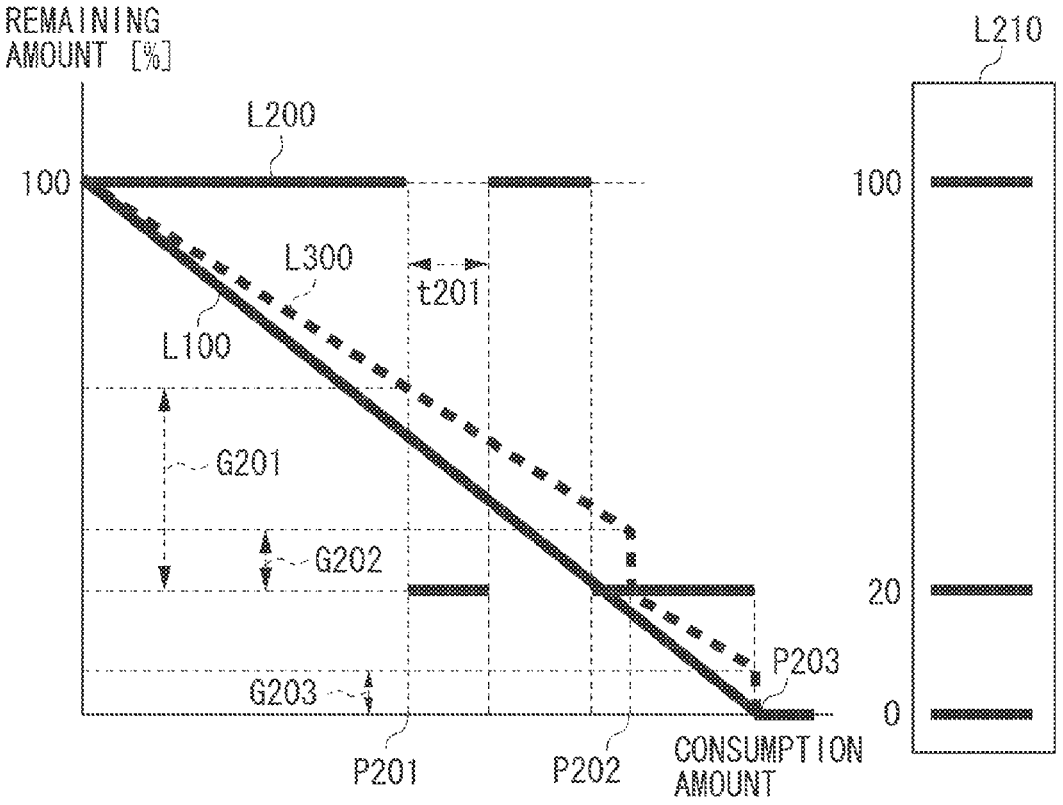

FIGS. 8A and 8B are diagrams illustrating changes in a remaining toner amount in a case where the remaining toner is falsely detected by the sensor in the middle of sensor value detection.

In some instances, the remaining toner may be falsely detected by the sensor. In such a case, the sensor value often deviates significantly from a current value. If such false detection is performed, the present exemplary embodiment does not allow the current value to be updated with the sensor value.

FIG. 8A illustrates a case where the present exemplary embodiment is not applied.

A time t201 indicates a time period in which a remaining toner is falsely detected by the sensor.

If the present exemplary embodiment is not applied, in a point P201, a current value of the remaining toner amount is updated with the sensor value of the remaining toner amount when the sensor value of the remaining toner amount temporarily reaches 20% due to false detection.

As a result, in a case where the present exemplary embodiment is not applied, the false detection of the sensor of the remaining toner amount may cause the current value of the remaining toner amount to significantly deviate from an actual remaining toner amount. Here, the false detection of the sensor refers to a case where the sensor falsely detects that the remaining toner amount has reached a predetermined amount although the actual remaining toner amount has not reached the predetermined amount.

FIG. 8B illustrates a case where the present exemplary embodiment is applied.

According to the present exemplary embodiment, in a point P201 illustrated in FIG. 8B, a current value of the remaining toner amount is not updated with a sensor value of the remaining toner amount when the sensor value of the remaining toner amount temporarily reaches 20% due to false detection. In the point P201, since a difference G201 between the sensor value and the current value is greater than a predetermined value, that is, an answer of NO in step S303 of the flowchart illustrated in FIG. 6, the current value is not updated with the sensor value.

On the other hand, in a point P202 illustrated in FIG. 8B according to the present exemplary embodiment, the current value of the remaining toner amount is updated with the sensor value of the remaining toner amount when the sensor value of the remaining toner amount reaches 20% based on correct detection. In the point P202 illustrated in FIG. 8B, since a difference G202 between the sensor value and the current value is less than the predetermined value, that is, YES in step S303 of the flowchart illustrated in FIG. 6, the current value is updated with the sensor value.

Moreover, in a point P203 illustrated in FIG. 8B according to the present exemplary embodiment, the current value of the remaining toner amount is updated with the sensor value of the remaining toner amount when the sensor value of the remaining toner amount is detected as 0%. In the point P203 illustrated in FIG. 8B, since the sensor value has already reached the low level (20%), and YES is selected in step S303 of the flowchart illustrated in FIG. 6 regardless of a difference G203 between the sensor value and the current value, the current value is updated with the sensor value.

According to the first exemplary embodiment, therefore, when a remaining toner amount is falsely detected by a sensor, a current value of the remaining toner amount can be prevented from significantly deviating from an actual remaining toner amount.

Next, a second exemplary embodiment will be described. In the first exemplary embodiment, the remaining toner amount is displayed on the printer side.

In the second exemplary embodiment, on the other hand, a remaining toner amount is displayed on a host computer side.

Specifically, the CPU of the data processing apparatus 101 acquires a current value of the remaining toner amount from a printer serving as the image forming apparatus 102 at predetermined timing (e.g., after a job is completed or when a predetermined time period has elapsed). Subsequently, the CPU of the data processing apparatus 101 displays the current value on a display unit thereof.

According to the second exemplary embodiment, the remaining toner amount can be checked on the host computer side, thereby enhancing user convenience.

Next, a third exemplary embodiment will be described. In the second exemplary embodiment, the remaining toner amount is displayed on the host computer side.

In the third exemplary embodiment, a remaining toner amount is not only displayed but also calculated on a host computer side. The present exemplary embodiment is particularly effective in a host-based print system (in which image data is rasterized in a host computer side).

Specifically, the CPU of the data processing apparatus 101 acquires information such as a sensor value and cartridge information from a printer serving as the image forming apparatus 102 at a predetermined timing (e.g., after a job is completed or when a predetermined time period has elapsed). With such information, the CPU of the data processing apparatus 101 performs the processing at the controller side illustrated in FIGS. 4 and 5. Subsequently, the CPU of the data processing apparatus 101 displays the current value on the display unit thereof.

According to the third exemplary embodiment, the remaining toner amount is calculated on the host computer side, thereby enabling reduction of a processing load on the printer side.

Other Embodiments

Embodiments of the subject matter of this application can also be realized by a computer of a system or apparatus that reads out and executes computer executable instructions recorded on a storage medium (e.g., non-transitory computer-readable storage medium) to perform the functions of one or more of the above-described embodiment(s), and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present subject matter has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-142794 filed Jul. 8, 2013, which is hereby incorporated by reference herein in its entirety.

What is claimed is:

1. An image forming apparatus for performing image forming on a sheet using a recording material, comprising:

a sensor that detects a remaining amount of the recording material;

a memory device that stores a set of instructions; and at least one processor that executes the instructions of:

estimating a remaining amount of the recording material using a dot counter;

notifying a user of the estimated remaining amount; and determining whether or not to notify a user of the remaining amount detected by the sensor based on a difference between the remaining amount detected by the sensor and the estimated remaining amount, wherein a notification of the remaining amount detected by the sensor is not issued under at least a condition that the difference is equal to or more than a predetermined threshold value.

2. The image forming apparatus according to claim 1, wherein it is determined to notify a user of the remaining amount detected by the sensor, in a case where the difference is less than the predetermined threshold value.

3. The image forming apparatus according to claim 1, further comprising a display, wherein a remaining amount of the recording material is displayed on the display in the notifying.

4. The image forming apparatus according to claim 1, wherein the recording material is toner.

5. A method of controlling an image forming apparatus that performs image forming on a sheet using a recording material, the method comprising:

estimating a remaining amount of the recording material using a dot counter;

notifying a user of the estimated remaining amount; and determining whether or not to notify a user of the remaining amount detected by the sensor based on a difference between the remaining amount detected by the sensor and the estimated remaining amount, wherein a notification of the remaining amount detected by the sensor is not issued under at least a condition that the difference is equal to or more than a predetermined threshold value.

6. A non-transitory computer-readable storage medium storing instructions that, when executed by a processor, executes a control method that controls an operation of an image forming apparatus, the control method comprising:

estimating a remaining amount of a recording material using a dot counter;

notifying a user of the estimated remaining amount; and determining whether or not to notify a user of the remaining amount detected by the sensor based on a difference between the remaining amount detected by the sensor and the estimated remaining amount, wherein a notification of the remaining amount detected by the sensor is not issued under at least a condition that the difference is equal to or more than a predetermined threshold value.

7. The image forming apparatus according to claim 1, wherein, whether or not to notify a user of the remaining amount detected by the sensor is determined based on the difference, in a case where the remaining amount detected by the sensor is determined to be less than the remaining amount which the user is notified of.

8. The image forming apparatus according to claim 1, wherein, even if the remaining amount detected by the sensor is determined to be under a predetermined remaining amount, the user is not notified of the remaining amount detected by the sensor in a case where the difference is equal to or more than the predetermined threshold value.

* * * * *